US006477815B2

(12) United States Patent
Paul et al.

(10) Patent No.: US 6,477,815 B2
(45) Date of Patent: Nov. 12, 2002

(54) SUSPENDED CEILING GRID STRUCTURE WITH MAIN RUNNERS INCORPORATING CODED MATCHING INDICIA FOR RECEIVING CROSS RUNNERS IN DESIRED SPACED APART FASHION

(76) Inventors: William Paul, 511 River Ridge Dr., Waterford Township, MI (US) 48327; Carol Paul, 511 River Ridge Dr., Waterford Township, MI (US) 48327

( * ) Notice: Subject to any disclaimer, the term of this patent is extended or adjusted under 35 U.S.C. 154(b) by 0 days.

(21) Appl. No.: 09/753,508

(22) Filed: Jan. 3, 2001

(65) Prior Publication Data

US 2002/0083667 A1 Jul. 4, 2002

(51) Int. Cl.[7] ..... E04B 9/00

(52) U.S. Cl. ..... 52/506.06; 52/506.07; 52/105

(58) Field of Search ..... 52/506.06, 506.07, 52/105

(56) References Cited

U.S. PATENT DOCUMENTS

| | | | | | |
|---|---|---|---|---|---|
| 2,187,087 | A | * | 1/1940 | Leary | 52/105 X |
| 3,374,596 | A | * | 3/1968 | O'Brien et al. | 52/105 X |
| 3,979,874 | A | | 9/1976 | Cubbler, Jr. et al. | |
| 4,161,856 | A | | 7/1979 | Brown et al. | |
| 4,406,104 | A | | 9/1983 | Beck et al. | |
| 4,437,273 | A | * | 3/1984 | Helfman | 52/643 X |
| 4,470,239 | A | | 9/1984 | Sauer | |
| 4,505,083 | A | | 3/1985 | Mieyal | |
| 4,525,973 | A | | 7/1985 | Vukmanic et al. | |
| 4,677,802 | A | | 7/1987 | Vukmanic | |
| 4,712,350 | A | | 12/1987 | Vukmanic | |
| 4,727,703 | A | | 3/1988 | Platt | |
| 4,923,032 | A | | 5/1990 | Nuernberger | |
| 5,044,138 | A | | 9/1991 | Zaccardeli et al. | |
| 5,159,791 | A | * | 11/1992 | Juhas | 52/90.1 |
| 5,216,865 | A | | 6/1993 | Lalonde et al. | |
| 5,666,778 | A | * | 9/1997 | Grattan et al. | 52/606 |
| 5,687,525 | A | * | 11/1997 | Koski et al. | 52/506.07 |
| 5,839,246 | A | | 11/1998 | Ziegler et al. | |
| 5,966,887 | A | | 10/1999 | Mieyal | |
| 5,970,672 | A | * | 10/1999 | Robinson | 52/270 |
| 6,047,511 | A | | 4/2000 | Lehane et al. | |
| 6,095,739 | A | * | 8/2000 | Albertson et al. | 411/439 |
| 6,178,712 | B1 | * | 1/2001 | Sauer | 52/506.07 |
| 6,230,464 | B1 | * | 5/2001 | Vrame | 52/506.08 |

* cited by examiner

*Primary Examiner*—Carl D. Friedman
*Assistant Examiner*—Brian E. Glessner
(74) *Attorney, Agent, or Firm*—Gifford, Krass, Groh, Sprinkle, Anderson & Citkowski, P.C.

(57) ABSTRACT

A marking system incorporated into a suspended grid structure supporting a plurality of ceiling tiles. A first plurality of main runners are suspending from a ceiling by hanger wires and in parallel, spaced apart and elongated extending fashion. Each of the main runners defines, in cross section, a tile support lip and a web extending from the support lip. A plurality of elongated channels are formed through first and second opposite faces of the main runner web at axially spaced apart intervals and between a first end and a second end. A second plurality of cross runners extend between the main runners and each also defines in cross section a tile support lip and a web extending in substantially perpendicular fashion from a midpoint of the support lip. First and second connector clips extend from associated first and second ends of each of the cross runners and engage, in laterally inserting fashion, through aligning channels defined in the main runners, opposing ends of first and second selected cross runners further engaging through an elongated channel of a selected main runner. A marking indicia is applied to selected channels of the main runners and identify proper location of the cross runners prior to engagement of the connector clips within the main runner channels. The marking indicia may further include coding selected channels according to at least one color indicia.

9 Claims, 2 Drawing Sheets

SUSPENDED CEILING GRID STRUCTURE WITH MAIN RUNNERS INCORPORATING CODED MATCHING INDICIA FOR RECEIVING CROSS RUNNERS IN DESIRED SPACED APART FASHION

BACKGROUND OF THE PRESENT INVENTION

1. Field of the Invention

The present invention relates generally to suspended ceiling grid structures and, more particularly, to a grid structure with main runners incorporating spaced apart receiving apertures designated by a specified coding system. Associated cross runners engage specified apertures of the main runners and which correspond to a subset code of the coding system. Applying a coding scheme to the main runners ensures correct lineal footage along the main runners for accurate alignment of the cross runners.

2. Description of the Prior Art

Suspended structures for creating ceiling grids are fairly well known in the art, the concept behind such structures being to provide suspended support for ceiling tiles. The tiles are typically rectangular shaped and acoustically insulating in nature and function to recreate a uniform and "dropped" ceiling appearance to an interior enclosure with an unfinished ceiling, such enclosures including commercial building interiors, as well as basement ceilings in residential dwellings.

U.S. Pat. No. 4,677,802, issued to Vukmanic, discloses one known arrangement of suspended ceiling system and runner and which is characterized by each of the runners being composed of a first member and a cap member. The first member is bent to form an inverted T-bar configuration with a groove extending inwardly from the flange of the T and the cap member having the same configuration and being secured on the flange of the T-bar configuration to form a channel with flange portions on each side for supporting panels of the ceiling system.

U.S. Pat. No. 4,712,350, also issued to Vukmanic, discloses a centering arrangement for T members of a suspended ceiling for holding a plurality of panels supported by the runners in a desired position on the flanges of the runners. The centering arrangement includes a bump extending from each side of a cross sectional web profile of the runner, the bump being formed in the web immediately adjacent a cut in the runner so that the drawing of the material into the bump will not draw material from the flange or adjacent thereto. The bump shape is preferably "half-moon" or semi-circular in configuration and so that it provides a smooth camming surface for both lateral movement of the panel along the flange as well as vertical movement towards the flange.

U.S. Pat. No. 4,525,973, again issued to Vukmanic, teaches a suspended ceiling system again teaching main runners and cross runners which are inter-engageable to define a rectangular grid system. Suitably configured and elongated apertures are formed in the webbed profile of the main runners in axially spaced apart fashion and which receive an appropriately configured connecting end of selected cross runners and so that the cross runners are engaged to the main runner in mutually engaging fashion and on opposite sides thereof. Additional examples of suspended ceiling grid systems are illustrated by the likes of U.S. Pat. No. 4,470,239, issued to Sauer, U.S. Pat. No. 4,727,703, issued to Platt, and U.S. Pat. No. 5,839,246, issued to Ziegler.

SUMMARY OF THE PRESENT INVENTION

The present invention is a marking system incorporated into a suspended grid structure supporting a plurality of ceiling tiles, the marking system ensuring proper alignment of cross runners with respect to parallel spaced apart main runners. Specifically, the marking system ensures that the cross runners are properly located before being engaged between the main runners at specified locations and over long running lengths of the main runners. Heretofore, a great shortcoming in the prior art has been the inability to correctly align cross runners with main grid structure runners over long extending lengths.

A first plurality of main runners are suspending from a ceiling by hanger wires and in parallel, spaced apart and elongated extending fashion. Each of the main runners defines, in cross section, a tile support lip and a web extending from the support lip. A plurality of elongated channels are formed through first and second opposite faces of the main runner web at axially spaced apart intervals and between a first end and a second end. The elongated channels each exhibit a unique configuration, such including an enlarged or diamond-like shape, the purpose for which will be subsequently described.

A second plurality of cross runners extend between the main runners at spaced increments and each also defines in cross section a tile support lip and a web extending in substantially perpendicular fashion from a midpoint of the support lip. First and second connector clips extend from associated first and second ends of each of the cross runners and engage, in laterally inserting fashion, through aligning channels defined in the main runners. In a preferred construction, the enlarged configuration of the channels permits opposing ends of first and second selected cross runners to be engaged with the main runner on opposite sides thereof. The connector clips may each firer include an outwardly flared tab portion, the purpose for which is to abut against an associated side edge of the elongated channel and to prevent inadvertent disengagement of the cross runner from the interengaged main runner.

A marking indicia is applied to selected channels of the main runners and identify proper location of the cross runners prior to engagement of the connector clips within the main runner channels. In one preferred variant, the marking indicia includes coding selected channels according to at least one color indicia, and preferably first, second, third and fourth color indicias. In a further application of this variant, the color indicias may be provided in the form of adhesively securable appliqués. It is also contemplated that the marking indicia may be provided upon both sides of the main runners in offsetting fashion and so that differing lineal standards may be employed on either side of the main runners.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION THE PREFERRED EMBODIMENTS

Figure 1:
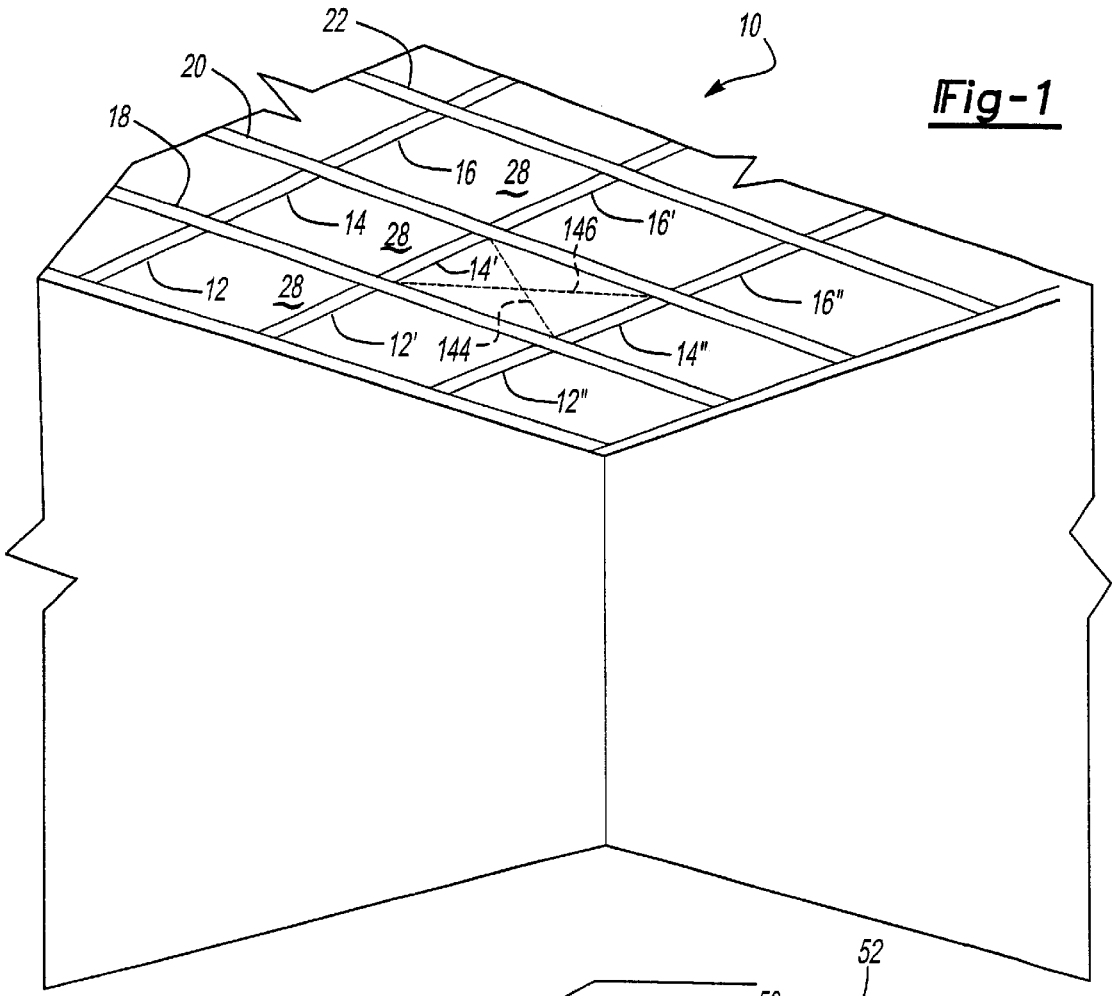
FIG. 1 is an environmental view illustrating a drop ceiling grid structure, and such as is provided by the marking system according to the present invention.

Referring now to FIG. 1, a general illustration of a drop ceiling grid structure is illustrated at 10 and which incorporates the marking system according to the present invention. As previously explained, the marking system ensuring proper alignment of pluralities of cross runners 12, 12', 12", et seq., 14, 14', 14", et seq., 16, 16' and 16", et seq., with respect to parallel spaced apart main runners 18, 20, 22, et seq. Specifically, the marking system ensures that the pluralities of cross runners 12, 14, 16 are properly located before being engaged between the main runners 18, 20, 22 at specified locations and over long running lengths of the main runners.

As was also previously explained, heretofore a great shortcoming in the prior art has been the inability to correctly align cross runners with main grid structure runners over these long extending lengths. Oftentimes, the installer of the grid structure has only realized a misalignment of an engaged cross runners after a significant number of subsequent runners have been installed based upon the faulty measurement. The purpose of the present invention is to provide an accurate and fail-safe coding or marking system to ensure that proper lineal alignment of the cross runners is maintained relative to the main runners.

Figure 2:
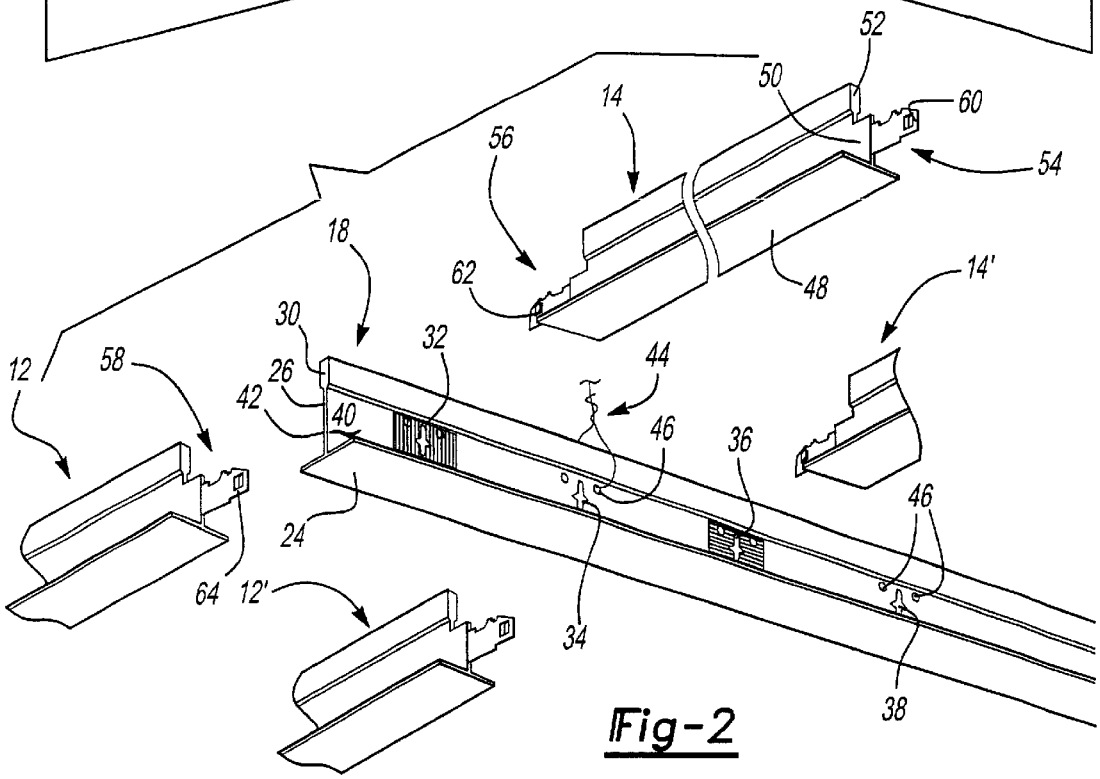
FIG. 2 is an exploded view in section of a main runner and opposing pairs of engageable cross runners according to the marking system of the present invention.

Referring now to FIG. 2, a partial view is illustrated of selected main runner 18 illustrated in exploded fashion with corresponding and cross wise extending runners 12 and 12' & 14 and 14'. While only a portion of the overall grid structure is illustrated, it is also understood that each and every of the spaced apart and parallel extending main runners and interengaging cross runners are constructed in substantially identical fashion. Accordingly, a repetitive description of each and every main runner and cross runner is not necessary for purposes of this description.

The main runner 18 is constructed as an elongate extending member and includes, in cross section, a tile support lip 24 and a web 26 extending from a substantial midpoint of the lip 24. The lip 24, as is well understood and which can also be viewed from FIG. 1, provides a ledge support surface to the extending edges of ceiling tiles, and which are representatively illustrated at 28 FIG. 1. Referring again to FIG. 2, the web 26 of the main runner 18 extends substantially upwardly from the tile support lip 24 and terminates in a thickened upper edge 30. The main and cross runners are both preferably constructed from planar shaped blanks of aluminum or like material and it is understood that the thickened upper edges (again shown at 30) may be provided by an extending portion of that blank which is folded over. It is further desirous to strengthen the main runner 18 from both cantilever and torsional forces over an axial direction, and this is provided in large part by the cross sectional configuration of the web 26 with enlarged upper edge 30.

A plurality of elongated channels 32, 34, 36, 38, et seq., are formed through first and second opposite faces 40 and 42 of the main runner 18 (see again FIG. 2) and at axially spaced apart intervals between first and second ends of the selected runner 18. The particular configuration of the channels 32, 34, 36, 38, et seq., is within the discretion of the individual skilled in the art, however it is contemplated that the channels will each include a substantially enlarged or diamond-shaped configuration as is clearly illustrated. The purpose of the channel configurations further being to facilitate insertion and engagement of the cross runners with the main runner and as will be further described. It is further contemplated that the channels are incrementally formed at six inch increments along the axially extending length of the main runner, however it is also contemplated that other incremental spacings, such a foot apart, can be employed and without departing from the scope of the present invention.

The main runner 18 is suspended from a ceiling (not shown) of the interior enclosure by hanger wires, see by example at 44, which extend through a selected one 46 of a plurality of apertures formed through the web 26 of the main runner 18 and at spaced apart intervals along its axially extending length. Referring again to the drawing Figs., the apertures are typically formed in pairs 46 in spaced fashion and corresponding to the arrangement of the channels 32, 34, 36, 38, et seq., along the main runner. It is further contemplated that other structure can be employed for suspending the runners from the ceiling and without departing from the scope of the invention.

Referring again to FIG. 2, the selected pluralities 12, 12' and 14, 14' of cross runners are illustrated, in reduced length for ease of presentation, and which interengage within selected apertures of the corresponding main runner 18. For purposes of ease in explanation, the cross runners are all identically constructed in cross section. Accordingly, and for explanatory purposes, the description shall be limited to selected cross member 14, which is illustrated in reduced length fashion.

Referring again to FIG. 2, cross member 14 includes a tile support lip 48, similar in construction to the corresponding support lip 24 of the main runner 18, and so that, upon interengaging the cross runners with the main runner, creates a continuous and rectangular extending edge for supporting the edges of the ceiling tiles 28.

The cross members, again representatively illustrated by cross member 14, each include a web 50 extending upwardly from a substantial midpoint of the tile support lip 48 and terminating in an enlarged or thickened upper edge 52 provided for substantially the same purposes of the thickened upper edge 30 of the afore-described main runner 18, e.g., that being to counteract bending and torsional forces along an axially extending length of each of the cross runners.

First and second connector clips 54 and 56 extend from first and second associated ends of each of the cross runners (e.g., cross runner 14). The connector clips 54 and 56 are typically secured to the opposite ends of the runner 14 by conventional means, such as rivets, and are further configured so that a selected and elongated channel (e.g., channels 32 and 36) is engaged by a single connector clip from one side, and/or opposing connector clips (see again 56 for cross runner 14 and 56 for cross runner 12). It is also contemplated that additional connector clips (not shown) are secured to extending ends of the main runners 18, 20, 22, et seq. and so that the grid structure can be secure against wall edge locations of the room enclosure.

In one preferred configuration, each of the connector clips 54, 56, 58, et seq., includes an outwardly flared tab portion, reference being made to flared portions 60, 62, 64, et seq., and corresponding to clips 54, 56, 58, et seq., respectively.

The provision of the outwardly flared tab portions causes the connector clips to abut against an associated side edge of each elongated channel and to thereby prevent inadvertent disengagement of the cross runner(s) from the interengaged main runner. Particular attention is drawn to the elongated channels 32 and 36, each of which exhibit the enlarged or diamond-shaped configurations which permit opposing connector clips of pairs of cross runners 12, 14 and 12', 14' to engage therethrough.

Figure 3:
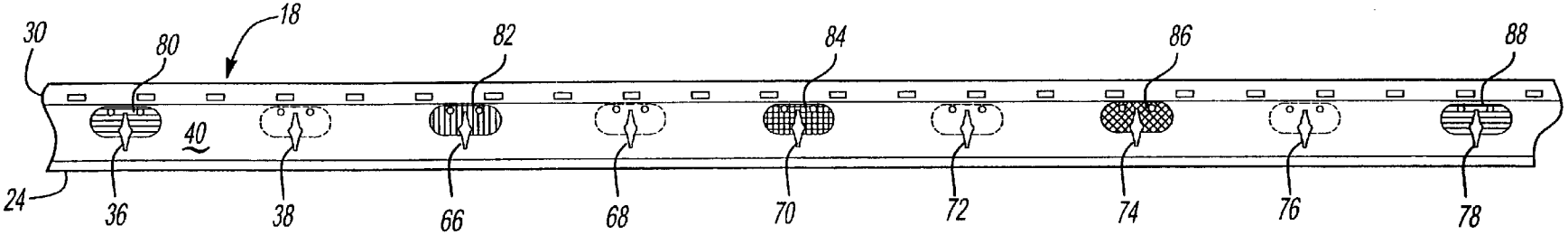
FIG. 3 is a plan view illustrating a first side of a selected main runner and exhibiting a first variation of marking indicia according to the present invention.
Figure 4:
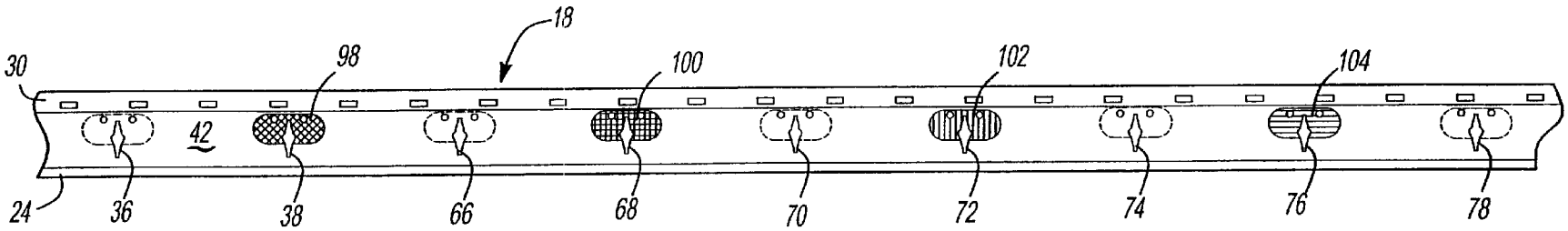
FIG. 4 is a plan view illustrating a second side of the selected main runner shown in FIG. 3 and exhibiting a second variation of marking indicia according to the present invention.
Figure 5:
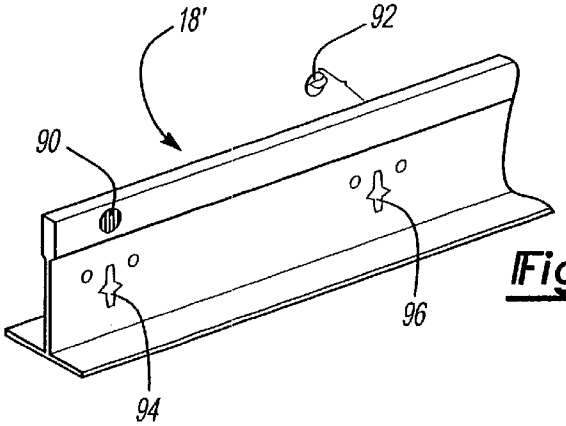
FIG. 5 is a sectional view of a second variation of the marking indicia and illustrating adhesively securable appliqués according to the present invention.

Referring again to FIG. 2, as well as to FIGS. 3 and 4, a marking indicia is illustrated which is applied to selected channels of the main runners (again referenced by main runner 18) and which identifies proper location of the cross runners prior to engagement of the connector clips within said main runner channels. Specifically, and referencing FIG. 3, an illustration is shown of the first side 40 of the selected main runner 18 and which includes color coded channels according to a plurality of colored indicia. Specifically, channels 36 and 38 are represented and further channels 66, 68, 70, 72, 74, 76, 78, et seq., are shown in progression.

Further illustrated are first 80, second 82, third 84 and fourth 86 selected color indicias and which correspond to selected and alternating channels 36, 66, 70 and 74. The indicia scheme presented typically repeats and a succeeding first color indicia is further shown at 88 for channel 78. The colors selected are within the discretion of one skilled in the art and one suggested applications contemplates blue 80, red 82, black 84 and white 86 (repeating again with blue 88 at channel 78). It is further contemplated that each color indicia is applied by a painting application. Referring further to a modified main runner 18', an alternative scheme is shown in which each color indicia is provided in the form of an adhesive appliqué and which is illustrated by appliqués 90 and 92 which are adhesively secured to apertures 94 and 96.

Referring again to FIG. 4, the reverse side 42 of the main runner 18 is illustrated and in which the color indicia has been offset, or shifted, relative to the channels. Specifically, white 98 coincides with channel 38, black 100 with channel 68, red 102 with channel 72 and, finally, blue 104 with channel 76. The purpose of the marking indicia provided upon both sides of the main runners in offsetting fashion is so that differing lineal standards may, at the election of the user, be employed on either side of the main runners and at the election of the user.

In any application, the marking indicia provides the user the ability to measure a correct lineal footage for spacing the engageable cross members. For example, cross members may be installed at every blue, red, black or white indicia marked channel. In the preferred example, the matching indicia are spaced at four foot increments to correspond with the sizing of the ceiling tiles and or light panels which are installed within the grid structure. The user may also choose to employ a different spacing standard on the reverse face of the main runner and which takes advantage of the offsetting pattern of the marking indicia.

Accordingly, the present invention discloses a novel and useful marking system for ensuring proper lineal alignment of cross runners with main runners of a grid structure. Additional preferred applications will become apparent to

We claim:

1. A marking system incorporated into a suspended grid structure supporting a plurality of ceiling tiles, said system comprising:

a first plurality of main runners and means for suspending said main runners from a ceiling in parallel, spaced apart and elongated extending fashion, each of said main runners defining, in cross section, a tile support lip and a web extending from said support lip, a plurality of elongated channels being formed through first and second opposite faces of said web at axially spaced apart intervals and between a first end and a second end;

a second plurality of cross runners extending between first and second selected main runners, each of said cross runners also defining, in cross section, a tile support lip and a web extending in substantially perpendicular fashion from a midpoint of said support lip, first and second connector clips extending from associated first and second ends of each of said cross runners and engaging, in laterally inserting fashion, through aligning channel defined in said first and second selected main runners; and a marking indicia applied to selected channels of said main runners and identifying proper location of said cross runners prior to engagement of said connector clips within said main runner channels, said marking indicia further comprising a plurality of individualized and varying markings established in a repetitive scheme corresponding to said axially spaced apart intervals of said main runners.

2. The marking system as described in claim 1, said marking indicia further comprising coding selected channels according to at least one color indicia.

3. The marking system as described in claim 2, further comprising first, second, third and fourth selected color indicias corresponding to selected alternating channels.

4. The marking system as described in claim 2, further comprising each color indicia being applied by a painting application.

5. The marking system as described in claim 2, further comprising each color indicia being applied by adhesive appliqués.

6. The marking system as described in claim 1, further comprising opposing ends of first and second selected cross runners engaging through an elongated channel and against opposite faces of a selected main runner.

7. The marking system as described in claim 6, each of said connector clips further comprising an outwardly flared tab portion, said tab portions abutting against an associated side edge of said elongated channel and preventing inadvertent disengagement of said cross runner from said interengaged main runner.

8. The marking system as described in claim 1, said means for suspending said main runners further comprising apertures formed through each of said main runner webs, hanger wires extending from the ceiling and looping through selected ones of said apertures.

9. A marking system system incorporated into a suspended grid structure supporting a plurality of ceiling tiles, said system comprising:

a first plurality of main runners and means for suspending said main runners from a ceiling in parallel, spaced apart and elongated extending fashion, each of said main runners defining, in cross section, a tile support lip and a web extending from said support lip, a plurality of elongated channel being formed through first and second opposite faces of said web at axially spaced apart intervals and between a first end and a second end;

a second plurality of cross runners extending between said main runners, each of said cross runners also defining, in cross section, a tile support lip and a web extending in substantially perpendicular fashion from a midpoint of said support lip, first and second connector clips extending from associated first and second ends of each of said cross runners and engaging, in laterally inserting fashion, through aligning channels defined in said main runners, opposing ends of first and second selected cross runners engaging through an elongated channel and against opposite faces of a selected main runner; and a marking indicia applied to selected channels of said main runners and identifying proper location of said cross runners prior to engagement of said connector clips within said main runner channels, said marking indicia further comprising coding selected channels according to at least one color indicia, said marking indicia further comprising a plurality of individualized and varying markings established in a repetitive scheme corresponding to said axially spaced apart intervals of said main runners.

* * * * *